United States Patent [19]

Reinke

[11] 4,010,590

[45] Mar. 8, 1977

[54] METAL ROOF SHINGLE

[76] Inventor: Richard F. Reinke, Box 566, Deshler, Nebr. 68340

[22] Filed: Apr. 16, 1975

[21] Appl. No.: 568,616

[52] U.S. Cl. ..... 52/533; 52/542; 52/547

[51] Int. Cl.[2] ..... E04D 1/00

[58] Field of Search ..... 52/533, 537, 547, 536, 52/542, 540

[56] References Cited

UNITED STATES PATENTS

| | | | |
|---|---|---|---|
| 1,251,310 | 12/1917 | Welch | 52/534 |
| 1,993,086 | 3/1935 | Chaffee | 52/542 |
| 3,135,070 | 6/1964 | Waring et al. | 52/542 |
| 3,415,029 | 12/1968 | Coletta | 52/540 X |

FOREIGN PATENTS OR APPLICATIONS

| | | | |
|---|---|---|---|
| 6,697 | 1/1898 | Norway | 52/538 |
| 219,634 | 10/1924 | United Kingdom | 52/537 |

*Primary Examiner*—Ernest R. Purser
*Assistant Examiner*—Carl D. Friedman
*Attorney, Agent, or Firm*—Clarence A. O'Brien; Harvey B. Jacobson

[57] ABSTRACT

A corrugated metal roof shingle provided with flashing of asphalt felt associated with the courses of overlapping shingles so that any water which blows under the shingles will drain out over a lower shingle. The shingles and flashing are arranged so that the nails which secure the shingles in place pass not only through the shingles but also through three layers of asphalt felt. The corrugation of the shingle provides maximum rigidity, hail resistance and ventilation under the shingle. The shingles have a shallow channel along one side edge thereof facing outwardly or upwardly and the lower edge thereof is inturned at a shallow angle with the shingles being provided in any suitable color, etch finished or the like with the structure of the shingle enabling ease of application and low manufacturing cost as well as being highly resistant to wind and easy to cut on an angle to fit a roof valley, hips, openings and the like with the fireproof characteristics of the shingles enabling a lower insurance rate thus not only providing a roof which is economical but also one which is long lasting and durable and impervious to deleterious effects of climatic conditions.

7 Claims, 5 Drawing Figures

METAL ROOF SHINGLE

BACKGROUND OF THE INVENTION

1. Field of the Invention

The present invention generally relates to a metal roof shingle and more particularly a shingle of corrugated metal, such as galvanized metal of suitable gauge or the like, with the shingle having an outwardly facing shallow channel along one side edge and an angularly disposed inwardly extending bottom edge with nail receiving openings positioned therein in such a manner that asphalt impregnated paper or felt material serving as flashing is positioned in such a manner that a layer of flashing underlies each of the shingle courses and is oriented so that each securing nail will pass through three layers of flashing thus effectively retaining the shingles and flashing in position with the flashing having a lower edge overlying the upper edge of an adjacent lower course of shingles.

2. Description of the Prior Art

Roof and siding shingles have been constructed of various materials including wood, ceramic material, various metals, asbestos, plastic and various combinations of such materials. Interlocking metal shingles have long been used both as a roof covering and siding and while such shingles are long lasting and durable, problems of leakage, buckling and difficulties in installation have deterred from the acceptance of such shingles by builders. Exemplary prior metal shingles are disclosed in U.S. Pat. Nos. 2,585, 208,819, 307,590, 1,059,682, 1,572,377, and 3,848,383.

SUMMARY OF THE INVENTION

An object of the present invention is to provide a metal shingle for use in building structures oriented in overlapping courses and provided with a shallow channel along one edge thereof which opens outwardly which receives a downwardly or inwardly opening corrugation on the side edge of an adjacent aligned shingle.

Another object of the invention is to provide a metal shingle combined with asphalt impregnated felt flashing underlying each layer of shingles with the lower edge of the flashing overlying the upper edge of an adjacent lower course of shingles and extending upwardly beyond the upper edge of an adjacent upper source of shingles so that nails passed through the shingles adjacent the lower edge thereof will pass through three layers of felt and slightly above the upper edge of the shingles in the next adjacent lower course of shingles thereby not only effectively mounting the shingles but also effectively sealing the nails and providing a weatherproof underlayment for the shingles so that any water blown under the shingles or in through the side edges thereof will be shed downwardly or drain out downwardly from the lower edge of the shingles.

A further object of the invention is to provide a metal shingle and flashing assembly in which the shingles are corrugated and provided with an angularly extending lower edge which enables ventilation under the shingles.

Still another important object of the invention is to provide metal shingles corrugated for rigidity and hail resistance, colored and finished in any suitable surface color or finish and constructed of metal of sufficient thickness to be rather rigid but enabling the shingle to be easily cut to fit various building components such as roof valleys and hips, openings in a roof or wall and around various corners, obstructions and the like which may be encountered in conventional building structures.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 5:
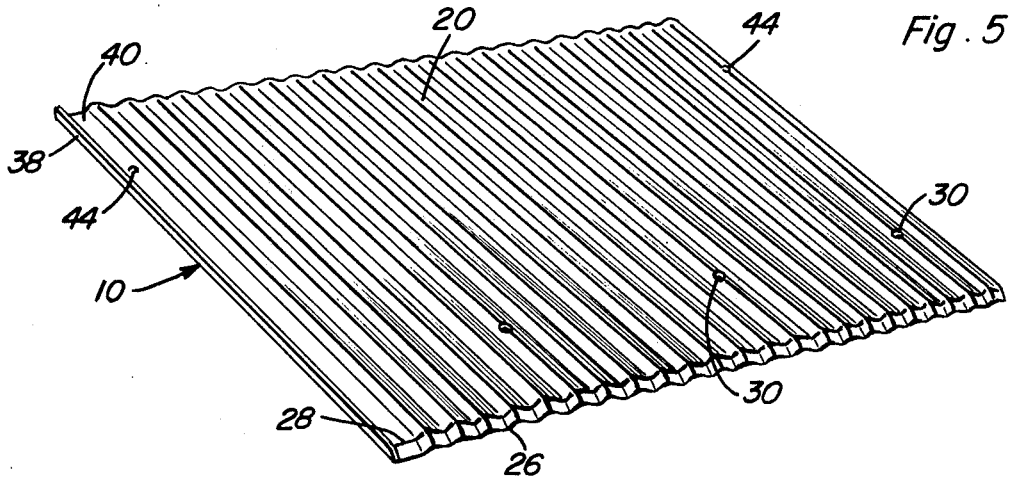
FIG. 5 is a perspective view of one of the metal shingles.

Referring now specifically to the drawings, the metal shingle of the present invention is generally designated by reference numeral 10 and a single shingle is illustrated in perspective in FIG. 5. A plurality of shingles 10 are installed either on the roof or on the side surfaces of a building with the drawings illustrating a plurality of shingles 10 mounted on the roof 12 of a building which is of conventional construction and for the purposes of illustration is disclosed as including a plurality of inclined rafters 14 having roof sheathing 16 secured to the upper surface thereof with the ends of the rafters 14 being interconnected by a facia board 18 thus defining the eave of the roof with the underlying roof structure of the building being conventional and forming no particular part of the present invention inasmuch as the rafters and sheathing may be of any suitable material secured in place in any suitable conventional manner. If the shingles are mounted on the side walls of the building, then the shingles would be attached to the side wall sheathing and studding in the same manner as they are installed on the roof.

Figure 1:
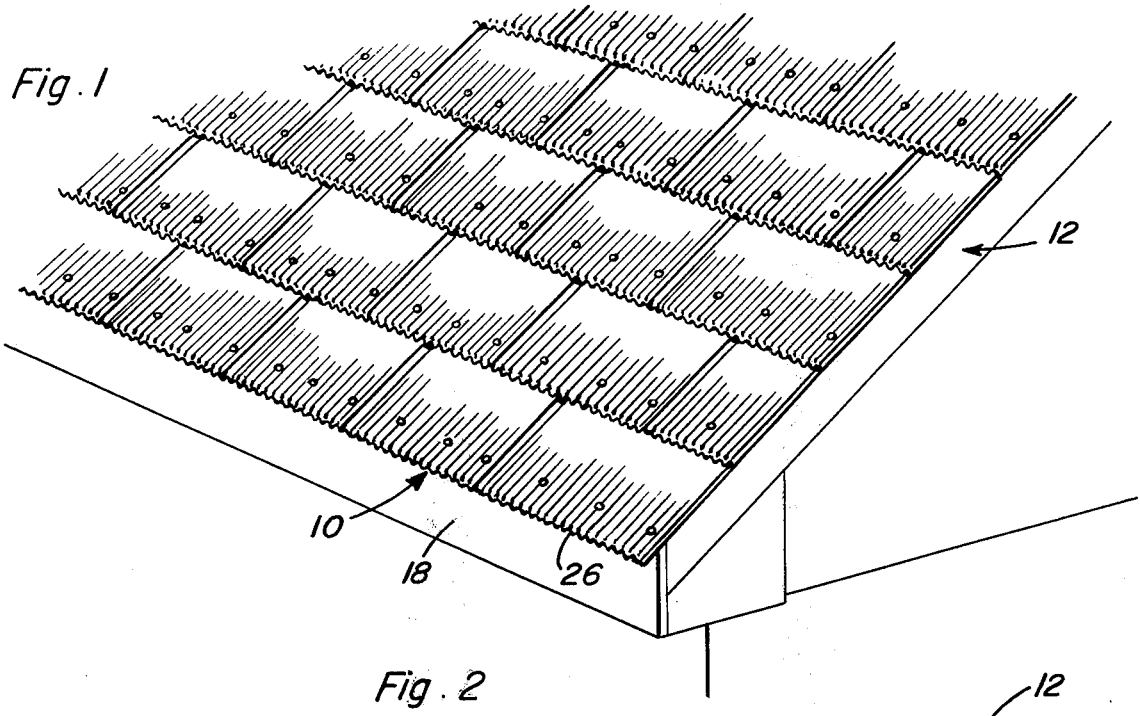
FIG. 1 is a fragmental perspective view of a lower corner portion of a roof illustrating the metal roof shingles and flashing incorporated thereon.
Figure 2:
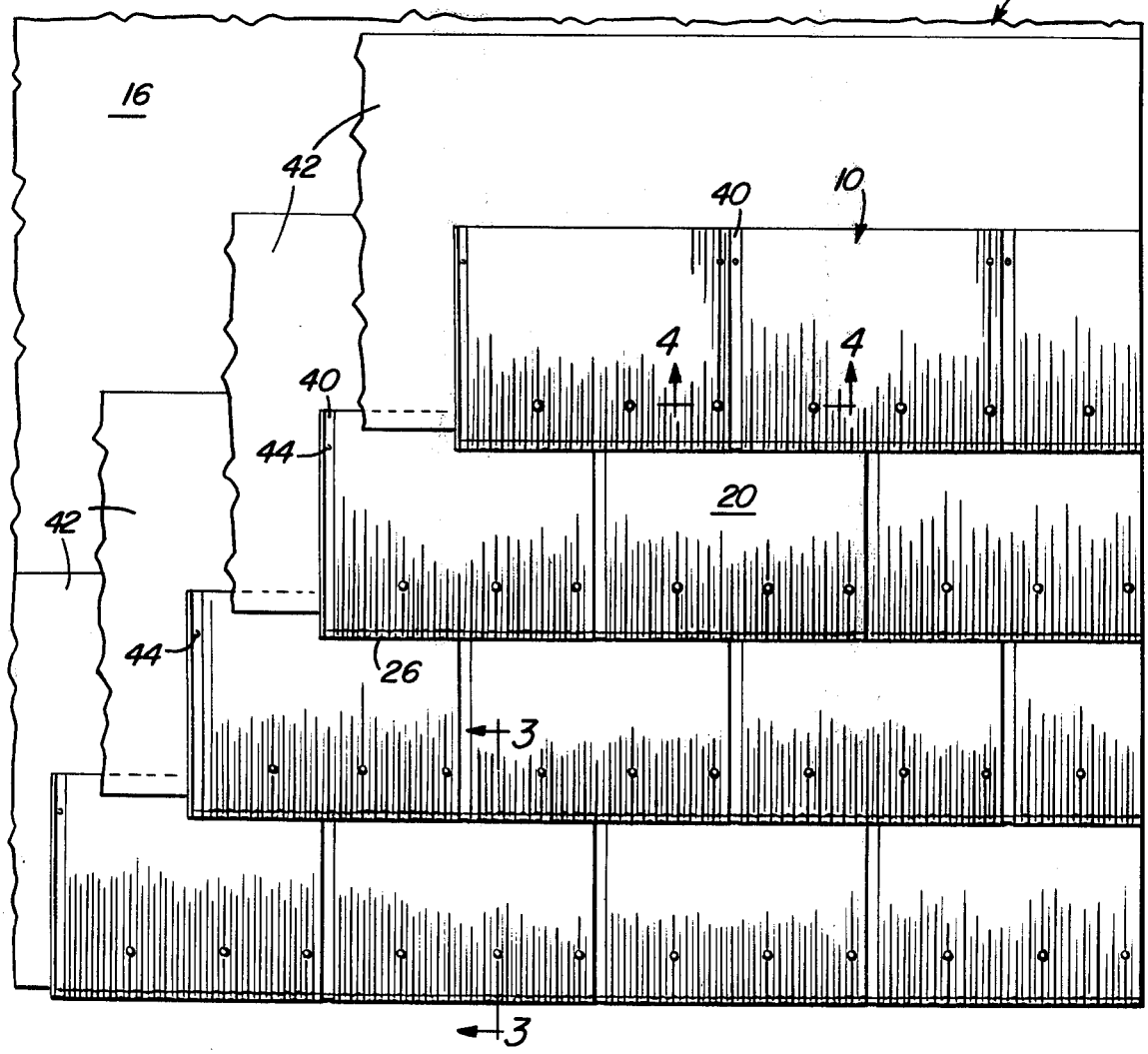
FIG. 2 is a top plan view of several courses of roof shingles and asphalt felt flashing illustrating the specific association of these components.

As illustrated, the shingles 10 are oriented in a plurality of horizontal courses or rows designated A, B, C, D with course A being disposed at the eave edge of the roof and projecting slightly beyond the eave edge to any desired conventional degree so that water dripping off of the eave edge will not run over the facia board but be deposited in a gutter if one is provided or otherwise be positioned away from the side of the building in a conventional and well known manner. Also as illustrated in FIGS. 1 and 2, the shingles 10 in the courses are disposed in staggered relation, that is, the juncture between the side edges of shingles in course B are aligned generally with the center of the shingles in course A in a well known manner of staggered application of shingles so that the side edges of the shingles in the adjacent courses being staggered.

Each shingle 10 is in the form of a rectangular panel 20 of sheet metal having parallel side edges which are perpendicular to parallel end edges with the panel including a plurality of shallow corrugations defining alternate ridges 22 and valleys 24 extending from the top edge to the bottom edge of the panel 20 in parallel relation to the side edges.

The bottom edge portion of the panel 20 is downwardly angulated as designated by numeral 26 with the downward offset or angulation of the lower edge portion 26 being relatively short in length and defined by a bend line 28. Spaced upwardly from the bend line 28, certain of the ridges 22 are provided with small openings 30 therethrough which receive fastening nails 32 which extend into the sheathing 16 for securing the shingles thereto with the nails 32 being ring shank nails provided with peripheral ridges or ribs which prevent withdrawal of the nails by expansion, contraction, wind and the like. As illustrated, the holes or openings 30 are positioned in the ridge 20 adjacent one edge of the shingle and the other two holes are oriented in slightly offset relation to the center of the panel and substantially spaced from the other side edge of the panel as illustrated in FIG. 2. The side edge of the panel 20 having a hole 30 adjacent thereto is defined by a downwardly facing valley or corrugation 34 which is symmetrical with the other corrugations or, if desired, the side edge 36 of the panel 20 may be provided with an outer edge which is oriented slightly more vertically than the other smoothly curved corrugations.

Figure 4:
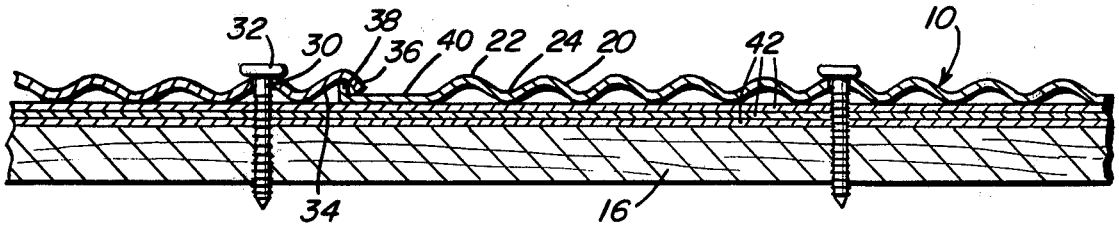
FIG. 4 is a detail sectional view, on an enlarged scale, taken substantially along section line 4—4 of FIG. 2 illustrating the edge-to-edge associational relationship of the shingles and the relationship of the underlying felt layers to the fastening nails.

The other side edge of the panel 20 is formed by an upstanding, generally vertical flange 38 which is interconnected with the first corrugation by a relatively wide flat surface 40 which coact to define an upwardly opening channel-shaped edge member of shallow configuration as perhaps best illustrated in FIG. 4 so that when the adjacent panels 20 in a course of shingles are overlapped, the downwardly facing valley receives the upwardly extending flange 38 with the downwardly extending edge 36 overlying the flat surface 40 and in engagement therewith thus interfitting and interlocking the adjacent shingles 10.

Figure 3:
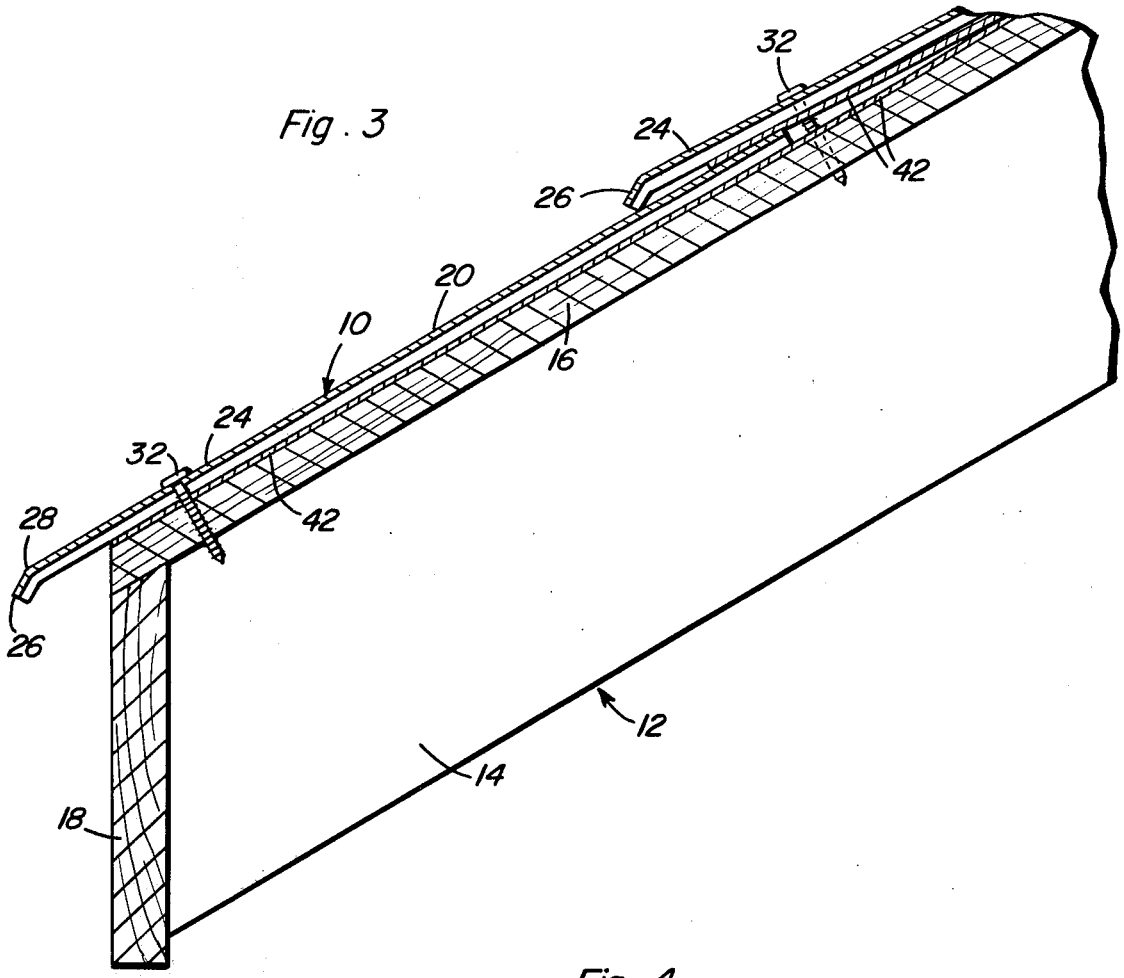
FIG. 3 is a vertical sectional view, on an enlarged scale, taken substantially upon a plane passing along section line 3—3 of FIG. 2 illustrating further associational relationship of the components of the invention.

The courses of shingles 10 are provided with strips of flashing 42 in the form of asphalt impregnated paper or felt material with a separate strip of flashing 42 being provided for each course of shingles. The lower course A of shingles 10 as illustrated in FIG. 2 has a strip of flashing 42 extending from a point adjacent the bend line 28 but slightly above the bend line with the width of the flashing being sufficient to extend upwardly beyond the lower course A of shingles 10 and also slightly beyond the upper edge of the next adjacent course B of shingles. The strip of flashing which underlies the course B of shingles has its lower edge overlying the upper edge of course A of shingles but also the lower edge of the flashing 42 underlying course B terminates slightly above the lower edge of the shingles in course B. Thus, the nails driven through the shingles in course C and any course of shingles above course C will pass through three layers of felt. By having a double thickness of flashing 42 under course A, then the nails driven through course B would also go through a triple layer of felt flashing and the nails driven through course A will go through two layers of felt flashing. The multiple layers of felt flashing and the specific relationship of the lower edge of the felt flashing where it is disposed on top of the upper edge portion of an underlying course of shingles provides for draining of any water downwardly along the upper surface of the underlying felt flashing back onto the upper surface of an adjacent lower course of shingles as illustrated clearly in FIG. 3. This drainage facility is provided by the corrugations which also enables ventilation of the area under the shingles so that any water or moisture which is blown up under the shingles or passes downwardly between the side edges thereof will drain out from the lower edge of the flashing and this area will be permitted to dry out due to circulation of air under the shingle.

To facilitate alignment of the courses of shingles, the edge portions thereof may be provided with indicating markings 44 spaced downwardly from the top edge thereof so that the lower edge of an overlying course of shingles may be properly positioned in overlapping relation to the upper edge portion of an adjacent underlying course of shingles. To facilitate proper positioning of the shingles on the flashing and the proper positioning of the flashing, the flashing strips 42 may also be provided with indicia such as distinguishable lines thereon which may be aligned with the top edge of a course of shingles over which the strip of flashing material is positioned and for alignment with the upper edge of an underlying strip flashing.

While the dimensional characteristics of the shingles may vary along with the flashing and while the thickness or gauge of the metal may also vary, the shingle should be relatively rigid and capable of withstanding desired wind loads, snow loads and the like and also be capable of supporting a person when installing the roof or repairing the same. In one practical application, the shingles are 10 inches from top to bottom edge with a 2 inch overlap thus providing an 8 inch exposure. The nail holes should be just over 2 inches from the bottom edge. For example, the nail holes may be 2⅛ inches or 2¼ inches from the bottom edge of the shingle. With the 10 inch shingles, the flashing 42 should be approximately 20 inches in width although this dimension may vary and the flashing may be wider if desired. This construction provides a metal roof covering or siding which is easy to apply, substantially rigid in construction, resistant to hail damage, resistant to wind lifting the panels, economical to manufacture, easily provided in desired colors or surface finishes, easy to cut at a desired angle, quite effective for shedding water and providing a seal for the securing nails and ventilation under the shingles thereby providing a long lasting and durable roof or siding for a building. The specific construction of the shingles and their overlapping arrangement permits any condensation or "sweating" caused by temperature changes to dry out thereby eliminating the moisture damage caused by moisture condensation on the inner surface of the shingles. Also the separation of the major portion of the shingles by the felt flashing provides sound deadening characteristics to the roof or siding.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A shingle comprising a metallic panel having substantially parallel end edges and substantially parallel top and bottom edges arranged perpendicular to the end edges, said panel including a plurality of corrugations formed therein with symmetrically curved transverse surfaces extending between the top and bottom edges, the bottom edge portion of the panel being downwardly bent along a bend line parallel to and adjacent to the bottom edge of the panel, said panel being straight from the bend line to the top edge one end edge of the panel having a shallow channel formed therein with one wall of the channel being defined by an upturned end edge on the panel, the bottom of the channel being defined by a relatively wide flat surface and the other wall of the channel being defined by a corrugation in the panel with the upturned edge of the panel being substantially equal in height to the height of the corrugations to enable the downwardly facing portion of the end corrugation on an adjacent panel to overlap the upturned end edge on the panel, said corrugations extending through the bend line with the lower edge portion of the shingle overlapping the upper edge portion of an adjacent lower shingle when installed in courses on the exterior of a building or the like.

2. The structure as defined in claim 1 wherein said panel includes a plurality of aligned apertures spaced above but adjacent the bend line for receiving fasteners with the row of apertures being disposed above the top edge of an adjacent underlying panel, said panel being provided with indicating means adjacent the upper edge thereof and disposed adjacent each end edge thereof for indicating the degree of overlap of the next adjacent upper panel.

3. The structure as defined in claim 2 together with underlying flashing means for said panel, said underlying flashing means including a strip of flexible waterproof material independent from the shingles and having a dimension from the top to the bottom edge thereof greater than the top to bottom edge dimension of the panel and having its lower edge disposed adjacent to but above the bend line for positioning in overlying relation to the upper edge portion of an underlying panel and extending sufficiently above the top edge of the panel so that fastening devices extending through the panel at a point adjacent the bend line but slightly above the bend line will penetrate multiple layers of flashing.

4. A weatherproof covering, such as siding or roofing, for a building comprising a plurality of rows of shingles in which the lower edge of an upper row of shingles overlaps the upper edge of a lower row of shingles and the end edges of the shingles in each row overlapping with the end edges of shingles in one row being staggered in relation to the end edges of the shingles in adjacent rows, and an underlying waterproof flashing in the form of a separate strip of flashing extending throughout the length of each row of shingles with the top to bottom edge dimension of the flashing being substantially greater than the top to bottom edge dimension of each row of shingles, each of said shingles being in the form of a metal panel having corrugations extending from top to bottom edge, the lower edge portion of each shingle being downwardly bent to provide space between the lower portion of an upper row of shingles and the upper portion of a lower row of shingles to enable drainage of moisture from under the upper row of shingles and enable air circulation under the upper row of shingles for enabling the undersurface of the shingles to dry, said shingle being straight from the top edge thereof to the downwardly bent lower edge portion said strip of flashing under each row of shingles having a lower edge extending between the upper surface of the upper edge portion of a lower row of shingles and the undersurface of the lower edge portion of an upper row of shingles and terminating above but adjacent to the downwardly bent portion, the upper edge of said strip of flashing extending above the upper edge of its associated row of shingles a distance to underlie all of the next upper row of shingles and a portion of the second adjacent upper row of shingles to provide a waterproof covering for the building in underlying and partially sandwiched relation to the rows of shingles, and fastening nails extending through each of the shingles in each row at a position adjacent the lower edge thereof but above the upper edge of an underlying lower row of shingles with the fastening means extending through multiple strips of flashing.

5. The structure as defined in claim 4 wherein one end edge of each shingle is provided with an upwardly shallow trough having a wide flat bottom portion and one edge of the trough being defined by an upturned end edge on the shingle and the other edge of the trough being defined by one of the corrugations in the shingle.

6. The structure as defined in claim 5 wherein the upturned end edge of the shingle is received in the downwardly opening endmost corrugation on the opposite end edge of an adjacent shingle, each shingle including a plurality of aligned openings receiving fastening nails therethrough, said aligned openings being disposed adjacent the lower edge of the shingles and sufficiently above the lower edge to pass downwardly above the top edge of an adjacent lower row of shingles.

7. The structure as defined in claim 6 wherein the lower edge of the flashing strip extends downwardly below the fastening nails and in-between the lower edge portion of the row of shingles and the upper edge portion of an adjacent lower row of shingles to shed water which passes through the shingles and enable drying of the area under the shingles.

* * * * *